US011035555B1

(12) United States Patent
Lee

(10) Patent No.: US 11,035,555 B1
(45) Date of Patent: Jun. 15, 2021

(54) DEVICE ATTACHED TO HAT VISOR

(71) Applicant: Wen-Sung Lee, Taichung (TW)

(72) Inventor: Wen-Sung Lee, Taichung (TW)

( * ) Notice: Subject to any disclaimer, the term of this patent is extended or adjusted under 35 U.S.C. 154(b) by 0 days.

(21) Appl. No.: 16/702,537

(22) Filed: Dec. 4, 2019

(51) Int. Cl.

| | |
|---|---|
| ***F21V 21/088*** | (2006.01) |
| ***F21L 4/08*** | (2006.01) |
| ***A42B 1/244*** | (2021.01) |
| ***F21V 23/06*** | (2006.01) |
| ***F21V 21/08*** | (2006.01) |

(52) U.S. Cl.
CPC ..... *F21V 21/0885* (2013.01); *A42B 1/244* (2013.01); *F21L 4/08* (2013.01); *F21V 21/0832* (2013.01); *F21V 23/06* (2013.01)

(58) Field of Classification Search
CPC .. F21V 21/0885; F21V 21/0832; F21V 23/06; F21L 4/08; A42B 1/244
See application file for complete search history.

(56) References Cited

U.S. PATENT DOCUMENTS

2008/0130272 A1* 6/2008 Waters ..... A42B 1/244 362/106
2008/0232092 A1* 9/2008 Carter ..... F21L 4/00 362/106
2015/0276188 A1* 10/2015 Osborn ..... F21V 23/023 362/106

FOREIGN PATENT DOCUMENTS

CN 108286669 A * 7/2018
WO WO-2016040776 A1 * 3/2016 ..... A42B 1/244

* cited by examiner

*Primary Examiner* — Mary Ellen Bowman

(57) ABSTRACT

A lighting device includes a lighting unit with a snapping member formed on each of two ends thereof. A lighting portion is formed to the lighting unit and located between the two snapping members. A room defined in the lighting unit. A light emitting unit is located in the room and includes a light emitting member which is located corresponding to the lighting portion. A switch is connected to the underside of the lighting unit and electrically connected to the light emitting unit so as to control the operation of the light emitting member. Two clip members are respectively connected to the two snapping members of the lighting unit, or two connection portions are respectively formed on the two ends of the lighting unit. The clip members or the connection portions are attached to the visor to maintain the lighting device to the underside of the visor.

15 Claims, 10 Drawing Sheets

DEVICE ATTACHED TO HAT VISOR

BACKGROUND OF THE INVENTION

1. Fields of the Invention

The present invention relates to a lighting device, and more particularly, to a lighting device that is removably attached to underside of a hat visor.

2. Descriptions of Related Art

A hat includes a visor and a crown, and the visor extends from the front end of the crown so as to be located above the user's eyes to at least block light from directly shining into the user's eyes. Some users wear baseball caps to jog in the night, in order to illuminate the roads, a lighting device is developed to be attached to the hat visor. However, most of the lighting devices require a revised visor which affects the appearance of the hat. Furthermore, some lighting devices are too heavy and not suitable to be attached to the visors.

The present invention is intended to provide a lighting device that is easily attached to the underside of a hat visor and eliminates the drawbacks mentioned above.

SUMMARY OF THE INVENTION

The present invention relates to a lighting device and comprises a lighting unit having a snapping member formed on each of two ends thereof. A lighting portion is formed to the front side of the lighting unit and located between the two snapping members. A room is defined in the lighting unit, and a light emitting unit is located in the room and includes a light emitting member which is located corresponding to the lighting portion. The light emitting member emits a light beam which passes through the lighting portion. A charging port is formed to the top of the lighting unit and electrically connected to the light emitting unit. A switch is connected to the underside of the lighting unit and electrically connected to the light emitting unit so as to control the operation of the light emitting member. Two clip members are respectively connected to the two snapping members on two ends of the lighting unit. Each clip member is connected to the snapping member from one of two ends thereof. Each clip member includes a groove defined through the two ends thereof. Each clip member clamps the peripheral edge of the visor by the groove. The lighting unit is located to the underside of the visor, and the lighting portion faces forward of a user who wears the hat.

Alternatively, the present invention relates to a lighting device and comprises a lighting unit which has two connection portions respectively formed on the top of two ends of the lighting unit. The two connection portions are to be attached to the underside of a visor. A lighting portion is formed to the front side of the lighting unit and located between the two connection portions. A room is defined in the lighting unit. A light emitting unit is located in the room and includes a light emitting member which is located corresponding to the lighting portion. The light emitting member emits a light beam which passes through the lighting portion. A charging port is formed to the top of the lighting unit and electrically connected to the light emitting unit. A switch is connected to the underside of the lighting unit and electrically connected to the light emitting unit so as to control the operation of the light emitting member. The lighting portion faces forward of a user who wears the hat.

The lighting device is completely attached to the underside of the visor so that the hat and the visor are maintained the same.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
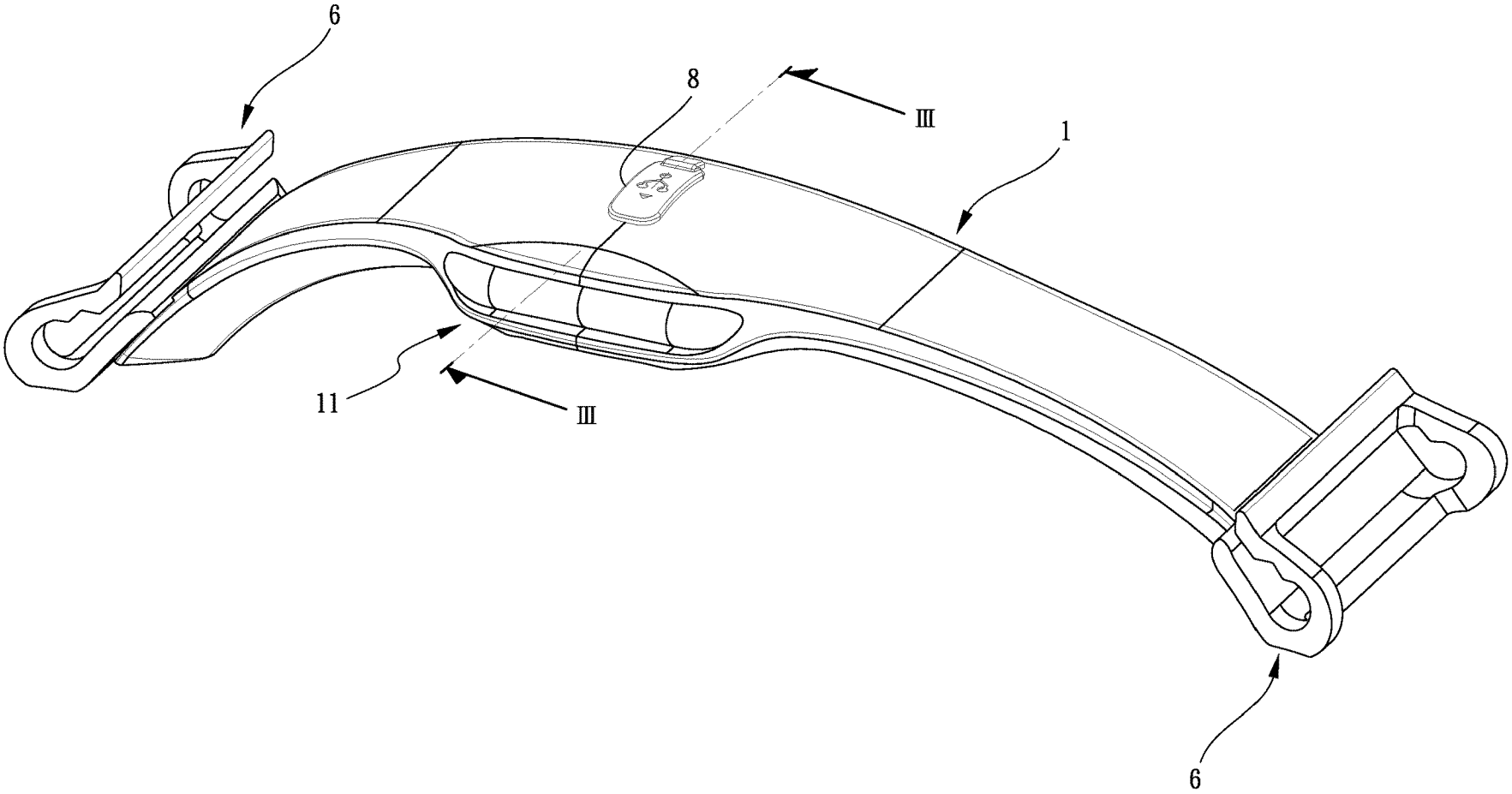
FIG. 1 is a perspective view to show the lighting unit of the present invention.
Figure 2:
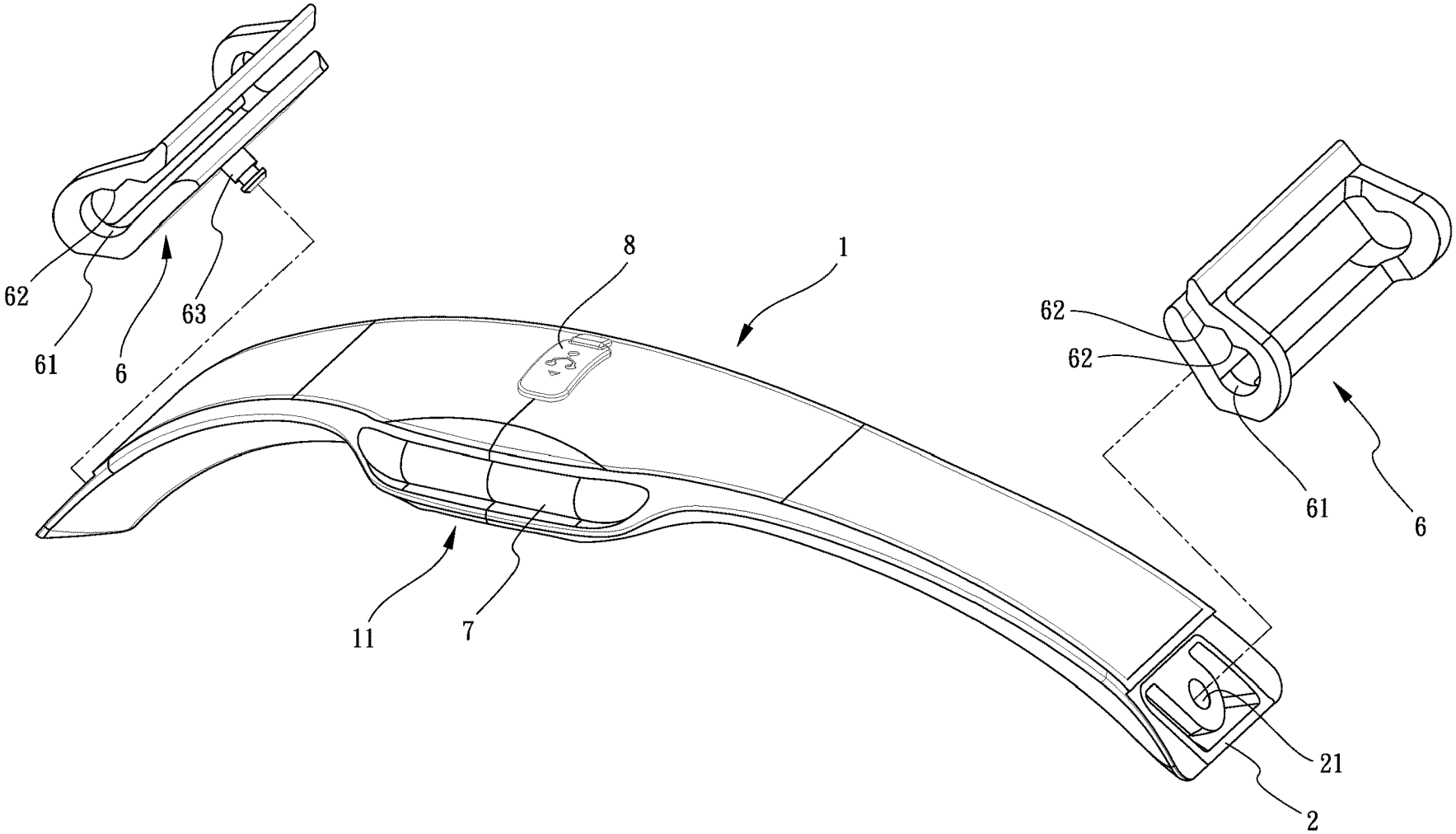
FIG. 2 is an exploded view of the lighting unit of the present invention.

Referring to FIGS. 1 to 6, the lighting unit 1 of the present invention comprises a lighting unit 1 which is an elongate unit and has a thicker portion at the middle and a thinner portion at each of two ends thereof. The lighting unit 1 includes a snapping member 2 formed on each of the two ends thereof. A lighting portion 11 is formed to the front side of the lighting unit 1 and located between the two snapping members 2. A room 12 is defined in the lighting unit 1, and a light emitting unit 3 is located in the room 12 and includes a light emitting member 31 which is located corresponding to the lighting portion 11. The light emitting member 31 emits a light beam which passes through the lighting portion 11. A charging port 4 is formed to the top of the lighting unit 1 and electrically connected to the light emitting unit 3. A switch 5 is connected to the underside of the lighting unit 1 and electrically connected to the light emitting unit 3 so as to control an operation of the light emitting member 31. Two clip members 6 are respectively connected to the two snapping members 2 on two ends of the lighting unit 1. Each clip member 6 is connected to the snapping member 2 from one of two ends thereof. Specifically, each clip member 6 includes a groove 61 defined through the two ends thereof, so that each clip member 6 clamps the peripheral edge of the visor 20 by the groove 61 thereof such that the lighting unit 1 is located to the underside of the visor 20 and close to the rear portion of the visor 20. The lighting portion 11 faces forward of a user who wears the hat 10. The light emitting member 31 illuminates the front area for the user who wears the hat 10. The lighting device 1 is completely attached to the underside of the visor 20 so that the hat 10 and the visor 20 are maintained the same.

When attaching the lighting unit 1 to a visor 20, the user clamps the clip members 6 that are connected to the lighting unit 1 to two lateral positions of the visor 20 and insert the visor 20 into the grooves 61 of the clip members 6. The lighting unit 1 is located to the underside of the visor 20 and the lighting portion 11 faces forward. By pressing the switch 5 to activate the lighting member 31, and the lighting member 31 emits a light beam to illuminate the front area of the user. By pressing the switch 5 again, the lighting member 31 is shut off.

Figure 8:
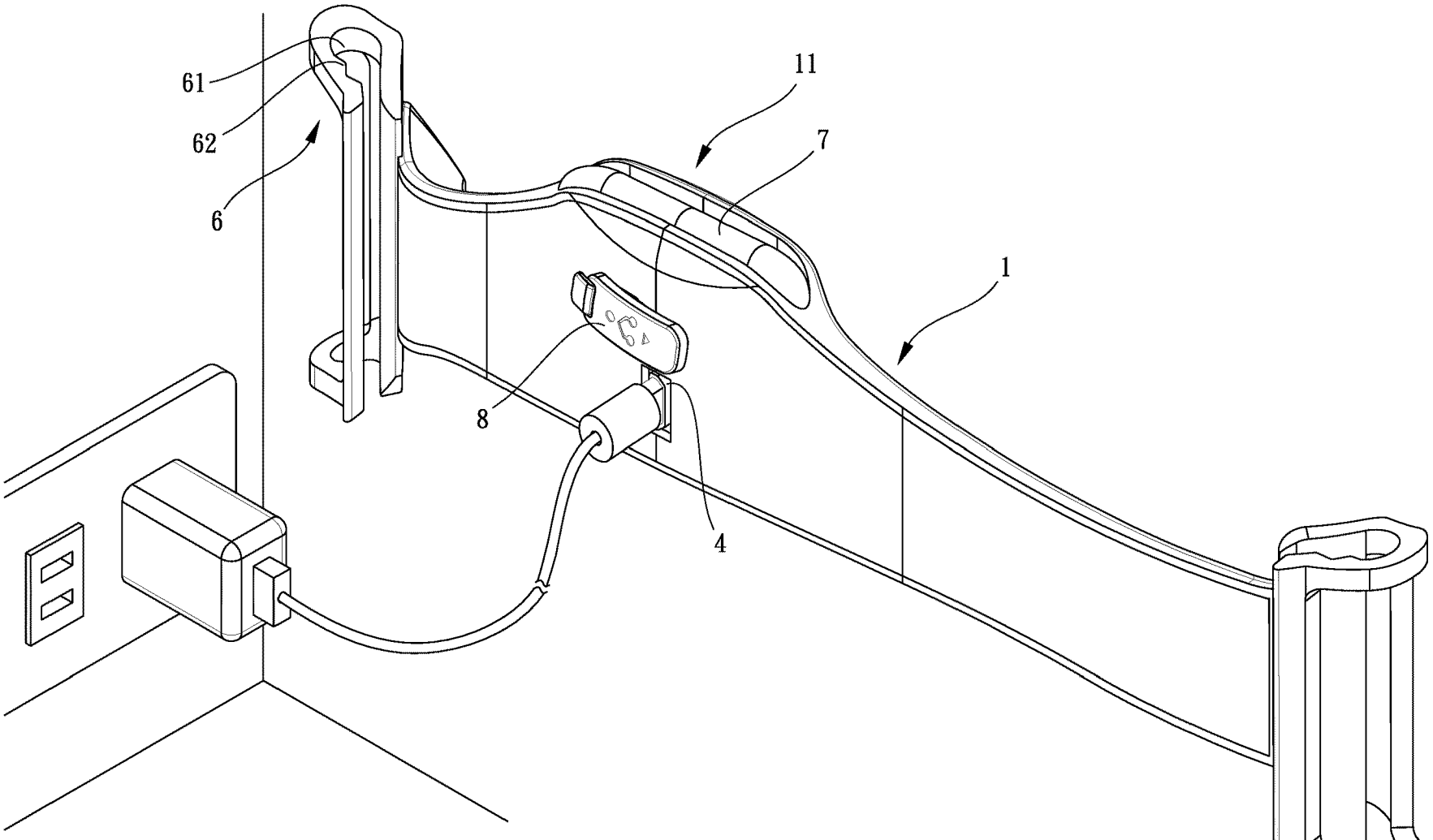
FIG. 8 illustrates that the lighting unit of the present invention is charged.

When the lighting unit 1 needs to be charged, the lighting unit 1 can be separated from the two clip member 6 or the lighting unit 1 is still connected with the clip members 6, and the lighting unit 1 can be connected to the receptacle on a wall or a mobile charger by the charging port 4 as shown in FIG. 8. It is noted that the lighting unit 1 is located close to the rear portion of the visor 20 to prevent the visor 20 from being bent.

Figure 7:
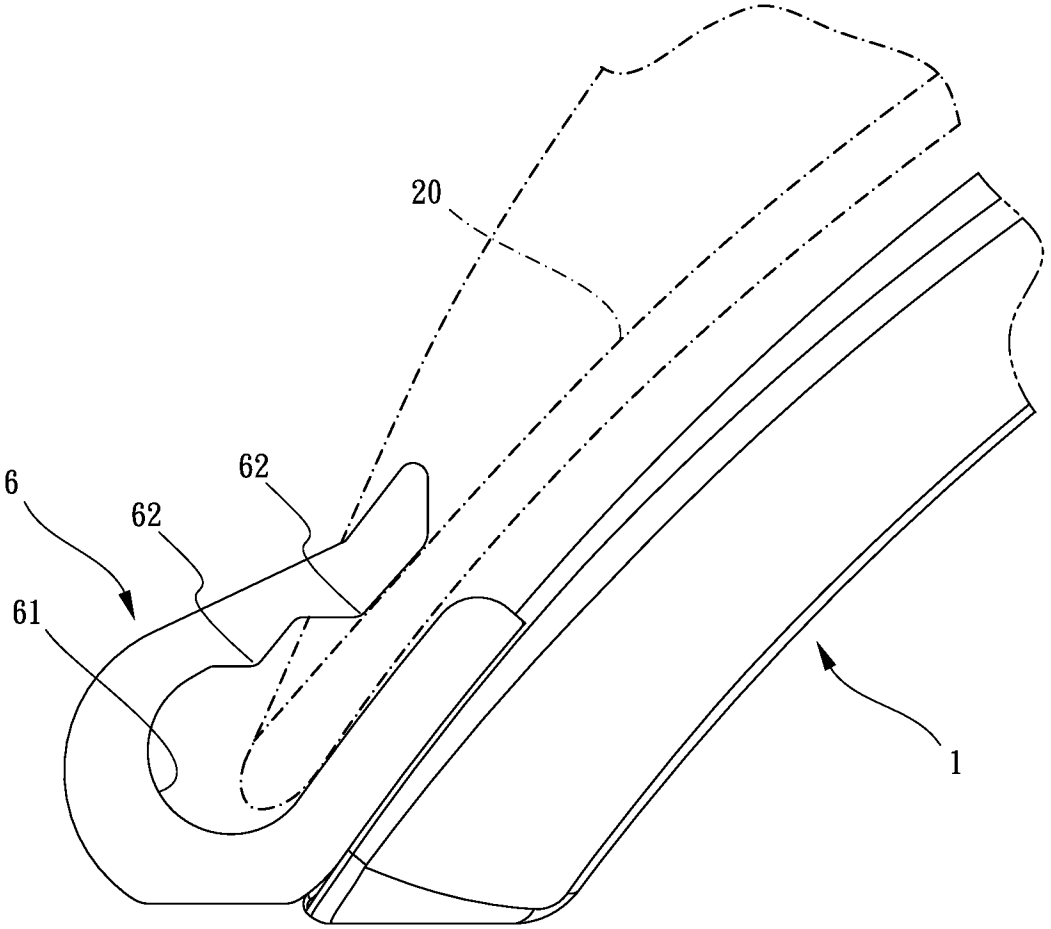
FIG. 7 shows that the clip member clips the visor.

In order to ensure that the clip member 6 to securely clamp the visor 20, at least one tooth 62 protrudes from the inside of the groove 61 of each clip member 6. The at least one tooth 62 extends between the two ends of each clip member 6 so that the at least one tooth 62 contacts the visor 20 and provides friction with the visor 20 to prevent the visor 20 from separating from the clip member 6 as shown in FIG. 7. Furthermore, each of the clip members 6 includes a pin 63, and each of the snapping members 2 includes a hole 21 in which the pin 63 of the clip member 6 corresponding thereto is inserted. Of course, other connection means such as magnets can also be used to connect the clip member 6 and the snapping members 2.

Figure 3:
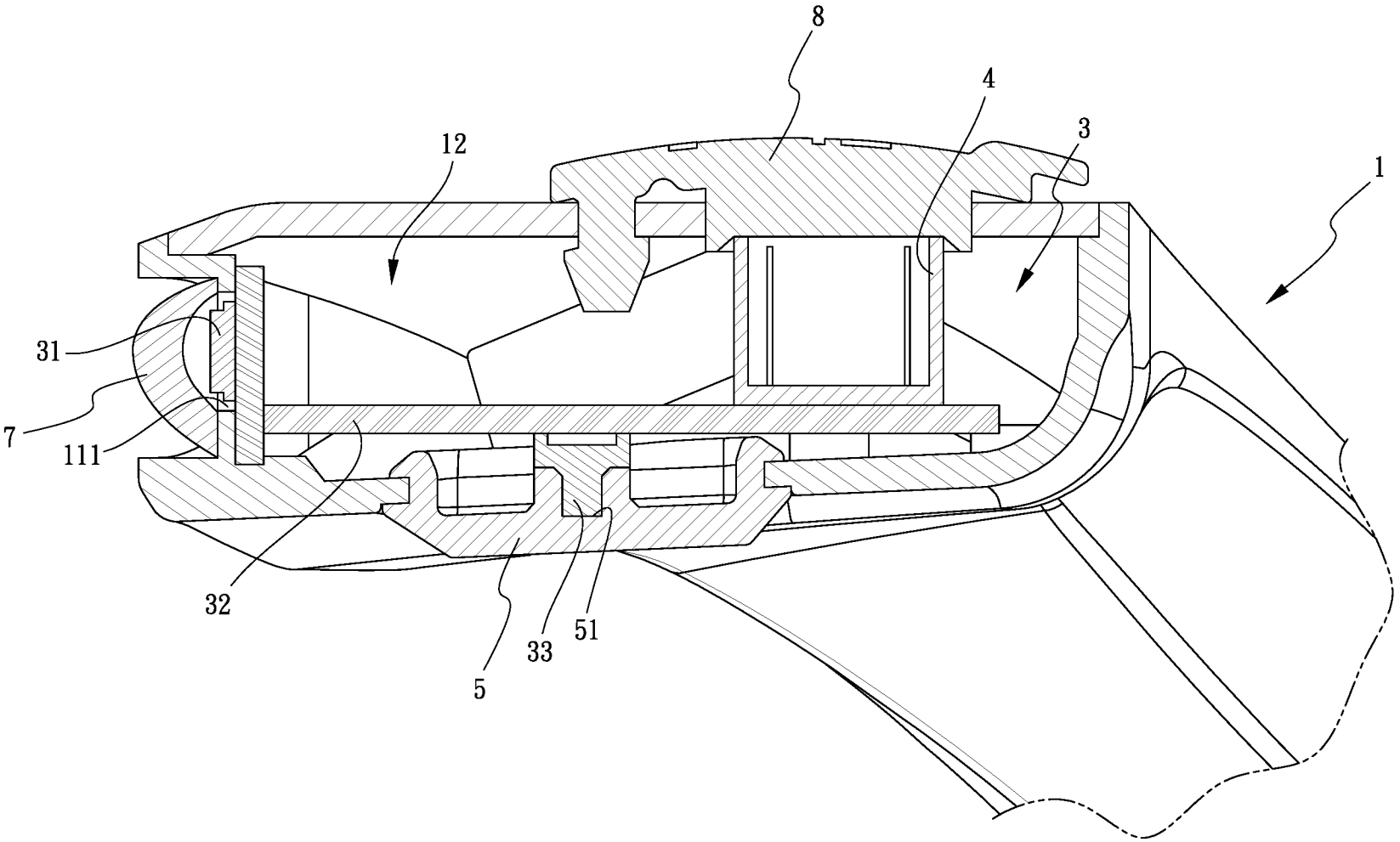
FIG. 3 is an cross sectional view, taken along line III-III of FIG. 1.
Figure 4:
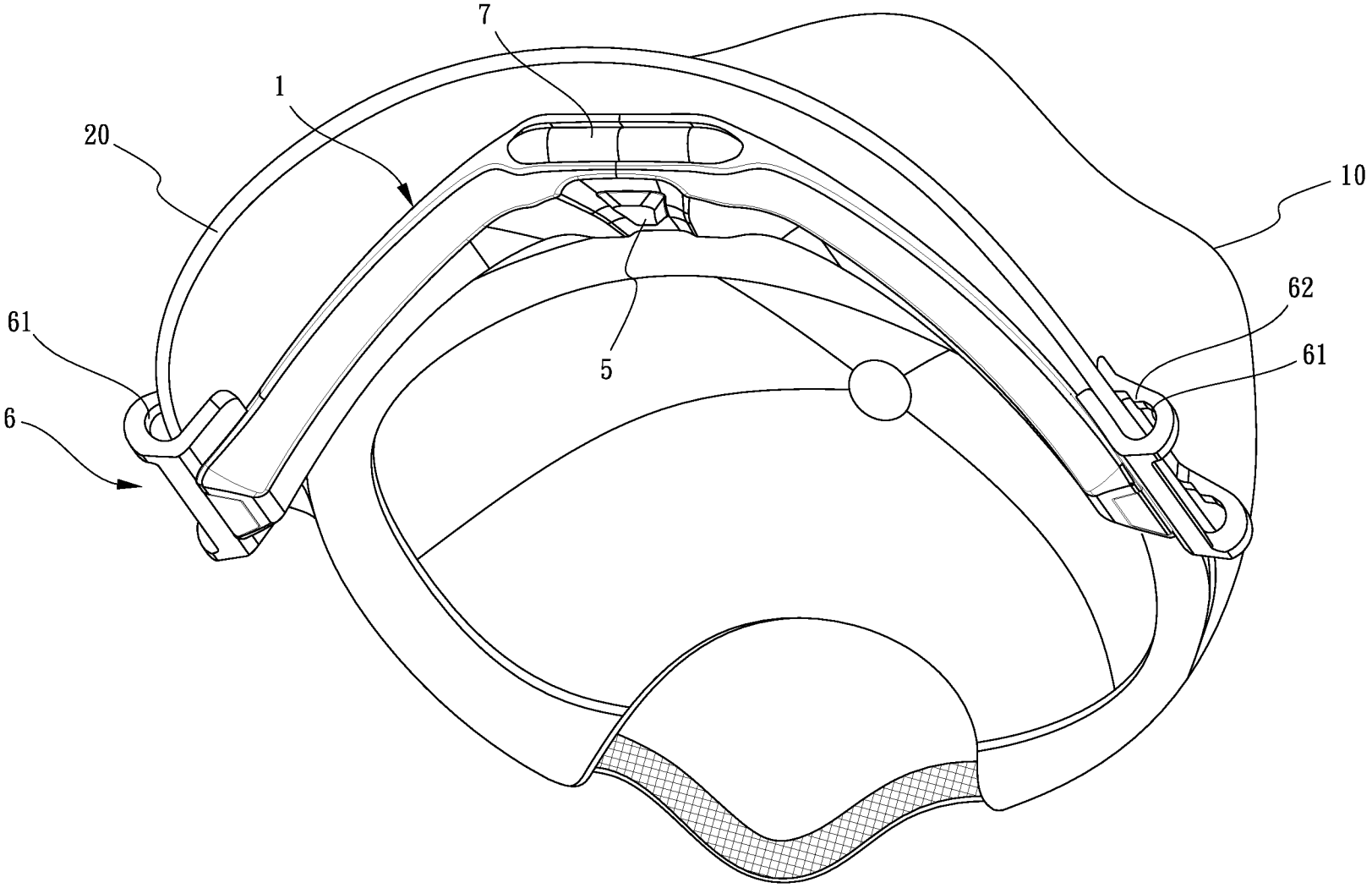
FIG. 4 shows that the lighting unit of the present invention is attached to the underside of a visor.
Figure 5:
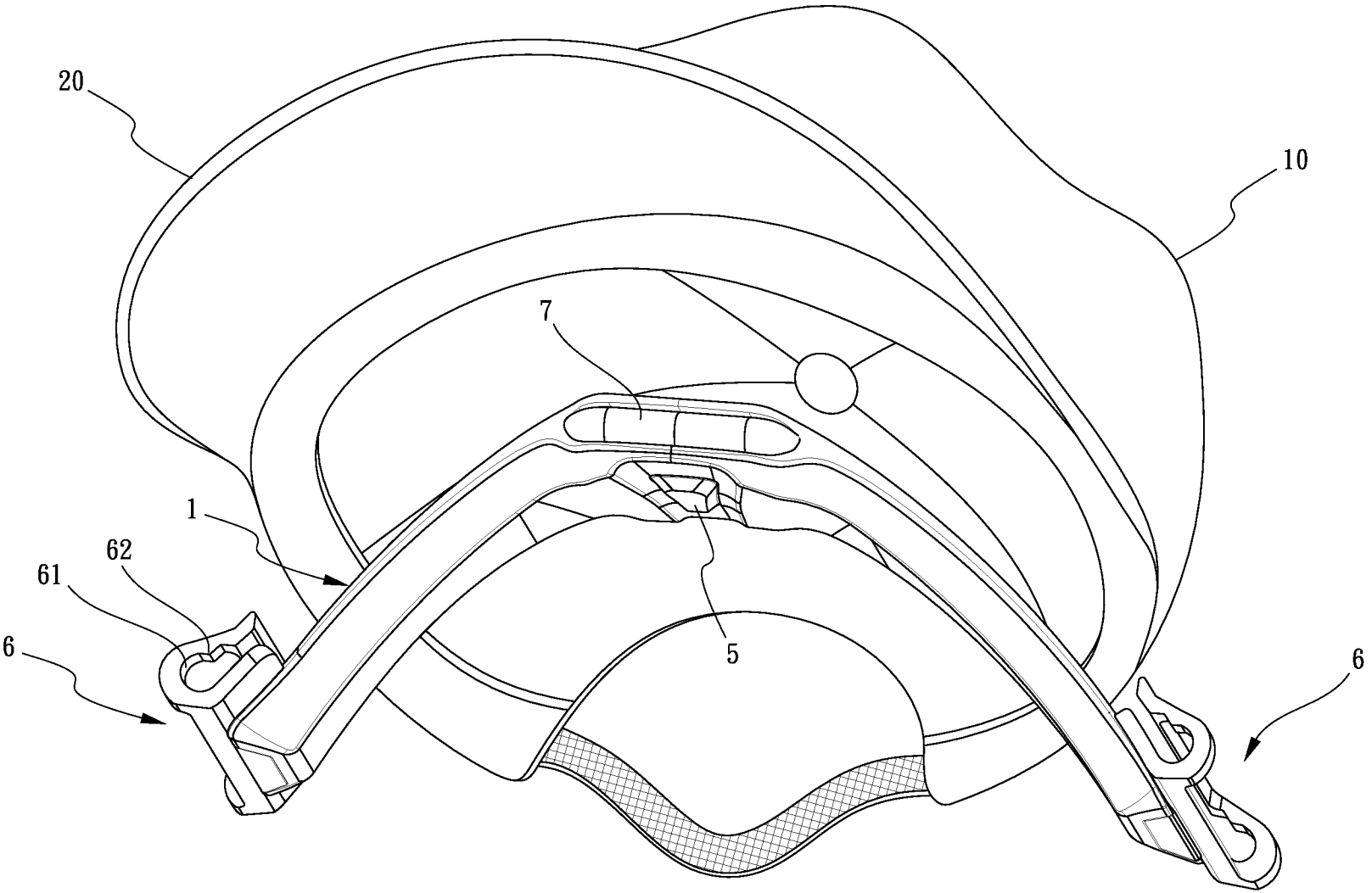
FIG. 5 shows that the lighting unit of the present invention and the visor to which the lighting unit of the present invention is to be attached.
Figure 6:
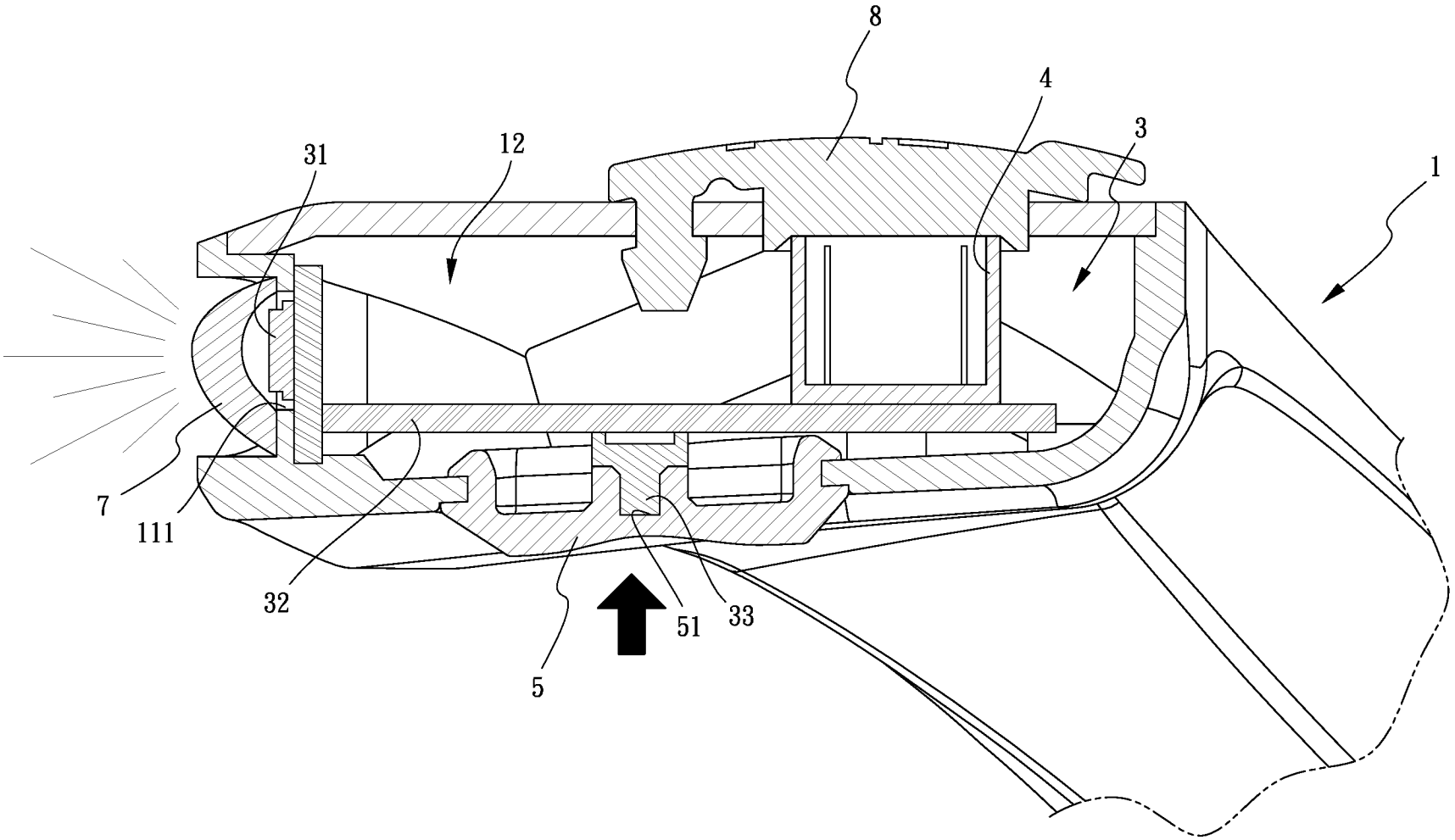
FIG. 6 is a cross sectional view to show that the button is pushed to activate the light emitting member.

In order to ensure that the light beam from the lighting member 31 is not blocked or covered, the lighting portion 11 includes a bore 111 which communicates with the room 12. The light emitting member 31 of the light emitting unit 3 partially protrudes through the bore 111. A case 7 is mounted to the lighting portion 11 and covers up the bore 111 and the light emitting member 31 of the light emitting unit 3 that partially protrudes through the bore 111. The case 7 is made of plastic or glass which can be translucent or transparent. The light emitting unit 3 further includes a circuit board 32 and a button 33. The button 33, the light emitting member 31 and the charging port 4 are electrically connected to the circuit board 32. The switch 5 includes a recess 51 and the button 33 is partially inserted into the recess 51, so that when the switch 5 is pressed, the button 33 is pushed as shown in FIGS. 3 and 6. A dust cover 8 is pivotably connected to the top of the lighting unit 1 and covers up the charging port 4. That is to say, the charging port 4 is accessed by pivoting the dust cover 8. As shown in FIG. 8, a charging cable is used to connect the charging port 4 and the power source. The switch 5 and the dust cover 8 are made of deformable rubber.

Figure 9:
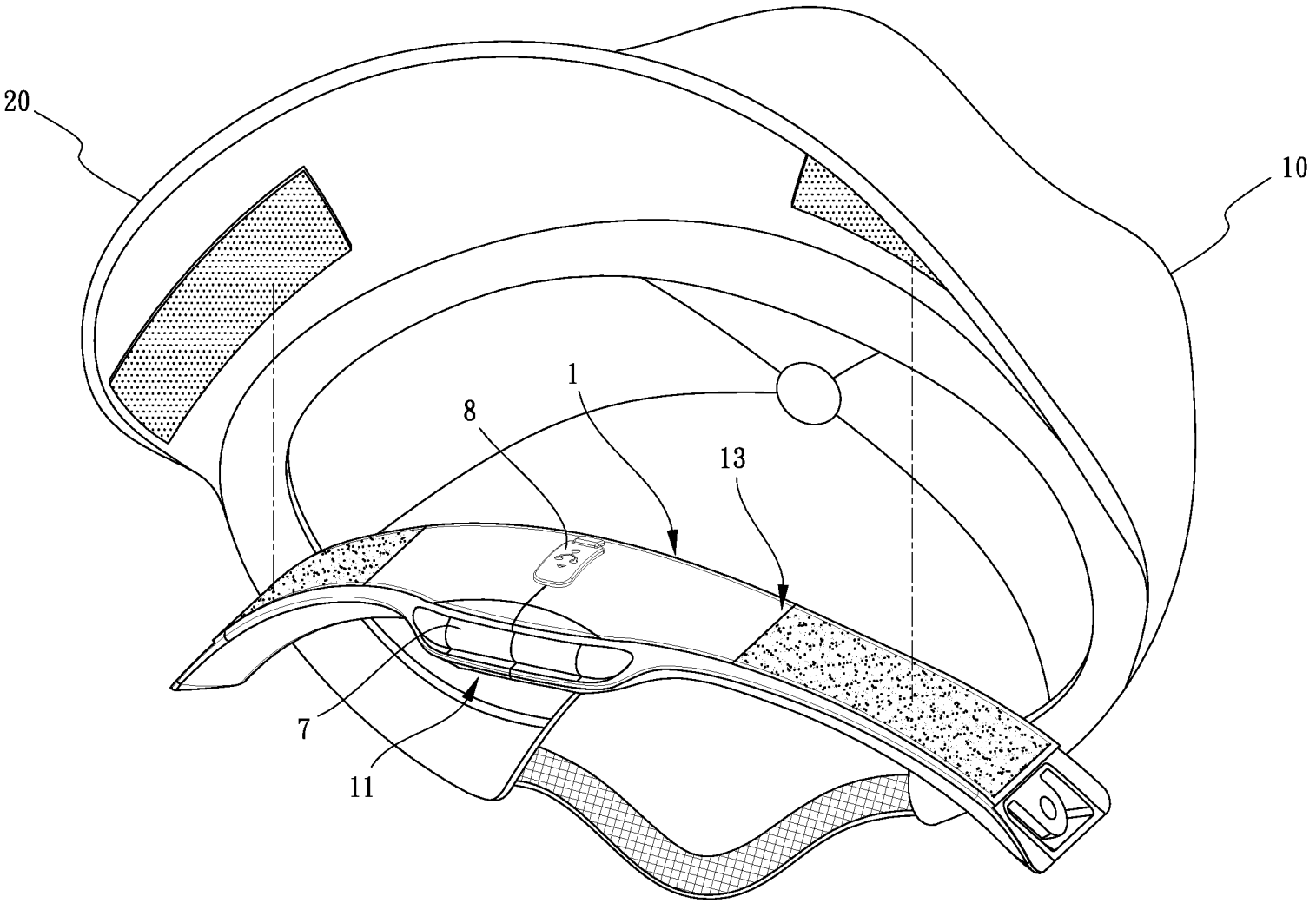
FIG. 9 is an exploded view of the second embodiment of the lighting unit of the present invention.
Figure 10:
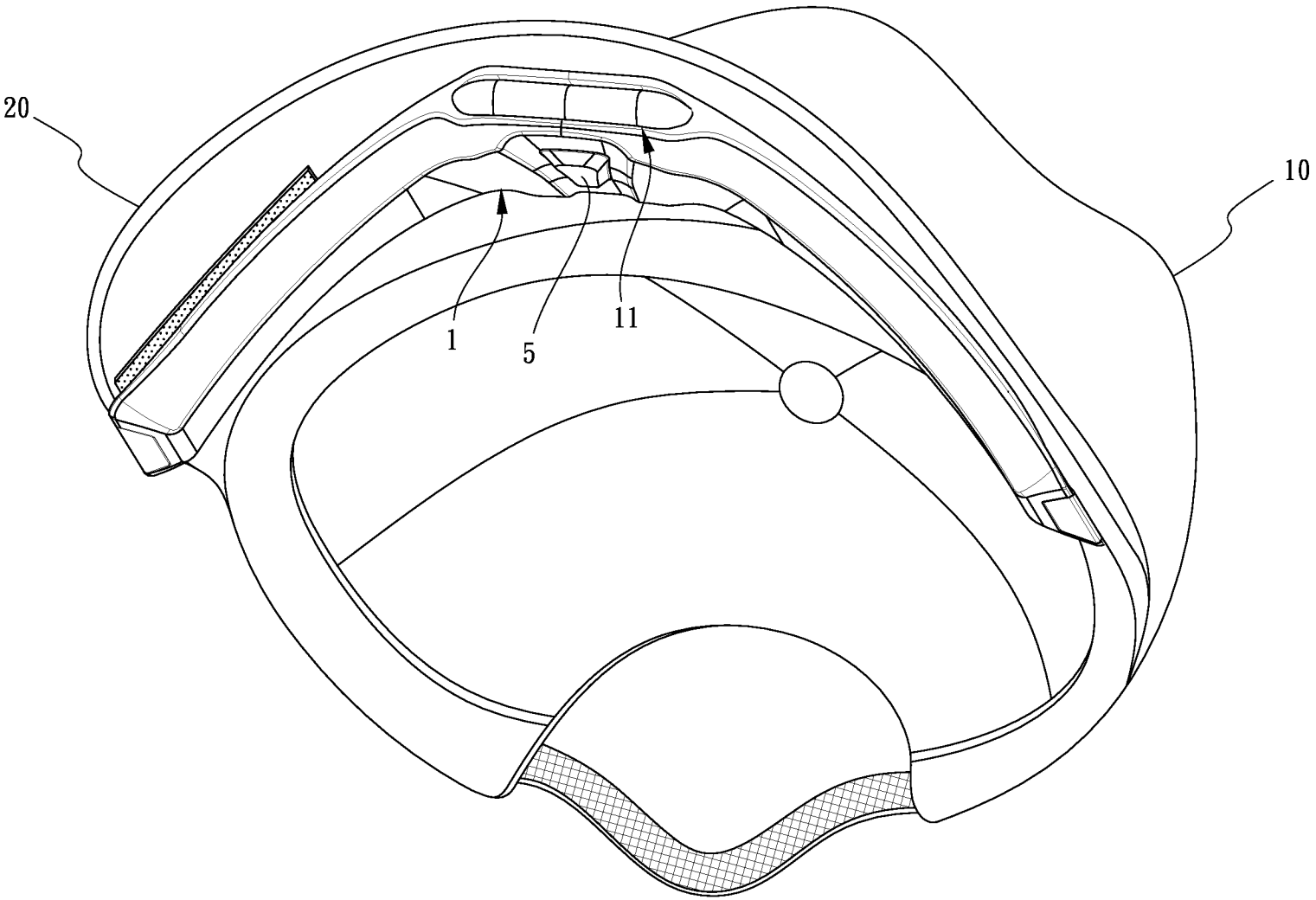
FIG. 10 shows that the lighting unit of the present invention shown in FIG. 9 is attached to the underside of a visor.

As shown in FIGS. 9 and 10, the present invention provides another embodiment of the lighting device, wherein the clip members 6 can be replaced by two connection portions 13 respectively formed on the top of two ends of the lighting unit 1. The two connection portions 13 are attached to the underside of the visor 20. Each of the two connection portions 13 can be a hook-and-loop strip which is adapted to be attached to another similar hook-and-loop strip on the visor 20. Each of two connection portions 13 may also be a male or a female connector, a female or a male connector is adapted to be connected to the visor 20.

The present invention is easily installed to the visor 20 and because the lighting unit 1 is located close to the rear portion of the visor 20, so that the visor 20 does not bent or deformed by the weight of the lighting unit 1. The lighting unit 1 of the present invention is made to be matched 10 with the curvature of the underside of the visor 20.

While we have shown and described the embodiment in accordance with the present invention, it should be clear to those skilled in the art that further embodiments may be made without departing from the scope of the present invention.

What is claimed is:

1. A lighting device attached to a visor of a hat, comprising:

a lighting unit having a snapping member formed on each of two ends thereof, a lighting portion formed to a front side of the lighting unit and located between the two snapping members, a room defined in the lighting unit, a light emitting unit located in the room and including a light emitting member which is located corresponding to the lighting portion, the light emitting member emitting a light beam which passes through the lighting portion, a charging port formed to a top of the lighting unit and electrically connected to the light emitting unit, a switch connected to an underside of the lighting unit and electrically connected to the light emitting unit so as to control an operation of the light emitting member, and two clip members respectively connected to the two snapping members on two ends of the lighting unit, each clip member connected to the snapping member from one of two ends thereof, each clip member including a groove defined through the two ends thereof, each clip member adapted to clamp a peripheral edge of the visor by the groove thereof so that the lighting unit is located at a rear portion of the visor, the lighting unit adapted to be located to an underside of the visor, the lighting portion adapted to face forward of a user who wears the hat.

2. The lighting device as claimed in claim 1, wherein at least one tooth protrudes from an inside of the groove of each clip member, the at least one tooth extends between the two ends of each clip member, the at least one tooth is adapted to contact the visor and to prevent the visor from separating from the clip member.

3. The lighting device as claimed in claim 1, wherein each of the clip members includes a pin, each of the snapping members includes a hole in which the pin of the clip member corresponding thereto is inserted.

4. The lighting device as claimed in claim 2, wherein each of the clip members includes a pin, each of the snapping members includes a hole in which the pin of the clip member corresponding thereto is inserted.

5. The lighting device as claimed in claim 1, wherein the lighting portion includes a bore which communicates with the room, the light emitting member of the light emitting unit partially protrudes through the bore, a case is mounted to the lighting portion and covers up the bore and the light emitting member of the light emitting unit that partially protrudes through the bore.

6. The lighting device as claimed in claim 5, wherein the light emitting unit includes a circuit board and a button, the button, the light emitting member and the charging port are electrically connected to the circuit board, the switch includes a recess and the button is partially inserted into the recess, the switch is pressed to push the button.

7. The lighting device as claimed in claim 6, wherein a dust cover is pivotably connected to the top of the lighting unit and covers up the charging port.

8. The lighting device as claimed in claim 7, wherein the switch and the dust cover are made of deformable rubber, the case is made of plastic or glass which can be translucent or transparent.

9. A lighting device attached to a visor of a hat, comprising:

a lighting unit having two connection portions respectively formed on a top of two ends of the lighting unit, the two connection portions adapted to be attached to an underside of the visor, a lighting portion formed to a front side of the lighting unit and located between the two connection portions, a room defined in the lighting unit, a light emitting unit located in the room and including a light emitting member which is located corresponding to the lighting portion, the light emitting member emitting a light beam which passes through the lighting portion, a charging port formed to the top of the lighting unit and electrically connected to the light emitting unit, a switch connected to an underside of the lighting unit and electrically connected to the light emitting unit so as to control an operation of the light emitting member, and the lighting unit adapted to be located to the underside of the visor and located at a rear portion of the visor, the lighting portion adapted to face forward of a user who wears the hat.

10. The lighting device as claimed in claim 9, wherein each of the two connection portions is a hook-and-loop strip which is adapted to be attached to the visor, or each of two connection portions is a male or a female connector, a female or a male connector is adapted to be connected to the visor.

11. The lighting device as claimed in claim 9, wherein the lighting portion includes a bore which communicates with the room, the light emitting member of the light emitting unit partially protrudes through the bore, a case is mounted to the lighting portion and covers up the bore and the light emitting member of the light emitting unit that partially protrudes through the bore.

12. The lighting device as claimed in claim 10, wherein the lighting portion includes a bore which communicates with the room, the light emitting member of the light emitting unit partially protrudes through the bore, a case is mounted to the lighting portion and covers up the bore and the light emitting member of the light emitting unit that partially protrudes through the bore.

13. The lighting device as claimed in claim 9, wherein the light emitting unit includes a circuit board and a button, the button, the light emitting member and the charging port are electrically connected to the circuit board, the switch includes a recess and the button is partially inserted into the recess, the switch is pressed to push the button.

14. The lighting device as claimed in claim 13, wherein a dust cover is pivotably connected to the top of the lighting unit and covers up the charging port.

15. The lighting device as claimed in claim 14, wherein the switch and the dust cover are made of deformable rubber, the case is made of plastic or glass which can be translucent or transparent.

* * * * *